US010576310B2

(12) United States Patent
Hung

(10) Patent No.: US 10,576,310 B2
(45) Date of Patent: Mar. 3, 2020

(54) FALL PROTECTION DEVICE

(71) Applicant: YOKE INDUSTRIAL CORP., Taichung (TW)

(72) Inventor: Wei-Chieh Hung, Taichung (TW)

(73) Assignee: YOKE INDUSTRIAL CORP., Taichung (TW)

( * ) Notice: Subject to any disclaimer, the term of this patent is extended or adjusted under 35 U.S.C. 154(b) by 0 days.

(21) Appl. No.: 15/677,162

(22) Filed: Aug. 15, 2017

(65) Prior Publication Data

US 2018/0289987 A1 Oct. 11, 2018

(30) Foreign Application Priority Data

Apr. 7, 2017 (TW) ..... 106111694 A

(51) Int. Cl.
*A62B 1/14* (2006.01)
*A62B 35/00* (2006.01)
(Continued)

(52) U.S. Cl.
CPC ..... *A62B 1/14* (2013.01); *A47L 3/00* (2013.01); *A62B 1/10* (2013.01); *A62B 35/0025* (2013.01);
(Continued)

(58) Field of Classification Search
CPC ..... A62B 1/14; A62B 35/0025; A62B 1/10; B65H 59/16
See application file for complete search history.

(56) References Cited

U.S. PATENT DOCUMENTS 3,760,910 A * 9/1973 Koshihara ..... A62B 35/0093 182/237
4,538,703 A * 9/1985 Ellis ..... E06C 7/186 182/10
(Continued)

FOREIGN PATENT DOCUMENTS

CN 106139431 A 11/2016
TW M550643 U 10/2017

OTHER PUBLICATIONS

Examination report for TW106119464, dated Mar. 5, 2018, Total of 6 pages.
(Continued)

*Primary Examiner* — Alvin C Chin-Shue
(74) *Attorney, Agent, or Firm* — R. Lynette Wylie; Apex Juris, pllc.

(57) ABSTRACT

A fall protection device includes a frame, a rotation unit, a safety belt, and a braking unit. The rotation unit is rotatably disposed in the frame; the safety belt is wound up on the rotation unit, and adapted to be pulled to drive a rotation of the rotation unit. The braking unit includes a braking plate, a braking block, and a stopper. The braking plate is connected to the rotation unit, rotates with the rotation unit coaxially. The braking block is pivotally connected to the braking plate, and includes a stopping part. The stopping part of the braking block can be spun out by a centrifugal force produced by a rotation of the braking plate, and abuts against the stopper to limit the rotation of the rotation unit. The braking block includes an abutted part. The stopper is disposed in a movement path of the abutted part.

7 Claims, 7 Drawing Sheets

(51) Int. Cl.

| | |
|---|---|
| ***E06C 7/18*** | (2006.01) |
| ***B65H 59/16*** | (2006.01) |
| ***A47L 3/00*** | (2006.01) |
| ***A62B 1/10*** | (2006.01) |
| *A47L 3/04* | (2006.01) |
| *A62B 1/20* | (2006.01) |

(52) U.S. Cl.
CPC ..... *A62B 35/0043* (2013.01); *A62B 35/0093* (2013.01); *B65H 59/16* (2013.01); *E06C 7/186* (2013.01); *A47L 3/04* (2013.01); *A62B 1/20* (2013.01)

(56) References Cited

U.S. PATENT DOCUMENTS 5,351,906 A * 10/1994 Feathers ..... A62B 1/10
182/237
8,181,744 B2 * 5/2012 Parker ..... A62B 1/10
182/232

OTHER PUBLICATIONS

Search report for TW106119464, dated Mar. 5, 2018, Total of 1 page.
English Abstract for CN106139431 (A), Total of 1 page.
English Abstract for TWM550643 (U), Total of 1 page.

* cited by examiner

FALL PROTECTION DEVICE

BACKGROUND OF THE INVENTION

1. Technical Field

The present invention is related to a fall protection device, and more particularly to a fall protection device adapted for the environments of hoisting operation.

2. Description of Related Art

When performing the building construction and the exterior wall cleaning or painting, the risk of falling for worker raises with the height of working sites. Workers usually wear a fall protection device with a safety belt when working in high places; the safety belt is attached to the worker and the fall protection device is secured to a supporting object. If the worker falls accidentally, the fall protection device and the safety belt are able to prevent the worker continue to fall so as to secure the safety of the worker.

Conventional fall protection device may include a rotation unit, a safety belt, and a braking unit. The safety belt can be connected to the rotation unit with one end and wound up on the rotation unit. The braking unit includes a braking plate, a braking block, and a stopper. The braking plate is connected to the rotation unit and rotates with the rotation unit coaxially; the braking block is also pivotally connected to the braking plate. When the braking block is spun out by a centrifugal force produced by a rotation of the braking plate, the braking block is engaged by the stopper to limit the rotation of the rotation unit. Hence, if the worker falls accidentally when performing hoisting operations, the braking unit is able to immediately lock up the rotation unit to prevent the worker continue to fall.

Though, the fall protection devices are usually used in dusty environments such that the braking block is probably adhered by dust. Dust adhesions on a pivoting connection of the braking block may cause the braking block unable to be spun out in emergency situations, and fail the lockup function thereof.

To prevent the dust, there is a fall protection device with a housing which is adapted to isolate the fall protection device from dust. However, the isolation brought from the housing is very limited, dust would still be brought into the housing by the safety belt exposed to the dust, adheres to the pivoting connection of the braking block, and eventually, fails the pivoting swing of the braking block.

BRIEF SUMMARY OF THE INVENTION

In view of the above, the present invention is to provide a fall protection device, with this fall protection device, its own pivoting swing status of a braking block can be confirmed.

The present invention is also to provide a fall protection device, wherein when the braking block is unable to pivotally swing, a rotation of a rotation unit is limited.

The present invention provides a fall protection device. The fall protection device includes a frame, a rotation unit, a safety belt, and a braking unit; wherein the rotation unit is rotatably disposed in the frame; the safety belt is wound up on the rotation unit and adapted to be pulled to drive a rotation of the rotation unit. The braking unit includes a braking plate, a braking block, and a stopper; wherein the braking plate is connected to the rotation unit and rotates with the rotation unit coaxially. The braking block includes a pivot-joint part, the pivot-joint part is pivotally connected to the braking plate. The braking block also includes a stopping part; wherein the stopping part of the braking block can be spun out by a centrifugal force produced by a rotation of the braking plate to abut against the stopper to limit the rotation of the rotation unit. The braking block includes an abutted part; wherein the abutted part and the stopping part are respectively disposed on two opposite sides of the pivot-joint part. The abutted part moves with the rotation of the braking plate along a movement path; the stopper is disposed in the movement path of the abutted part. Whereby, when the abutted part passes by the stopper, the abutted part is abutted against by the stopper so as to make the braking block swing pivotally.

Thus, the user can pull the safety belt in advance to check the vibrations produced by the swing of the braking block and confirm the fall protection device 100 operates normally. It is worth to mention that when the braking block is locked and unable to pivotally swing, the stopping part of the braking block is abut against the stopper to limit the rotation of the rotation unit so as to prevent the user continue to fall.

DETAILED DESCRIPTION OF THE INVENTION

Figure 1:
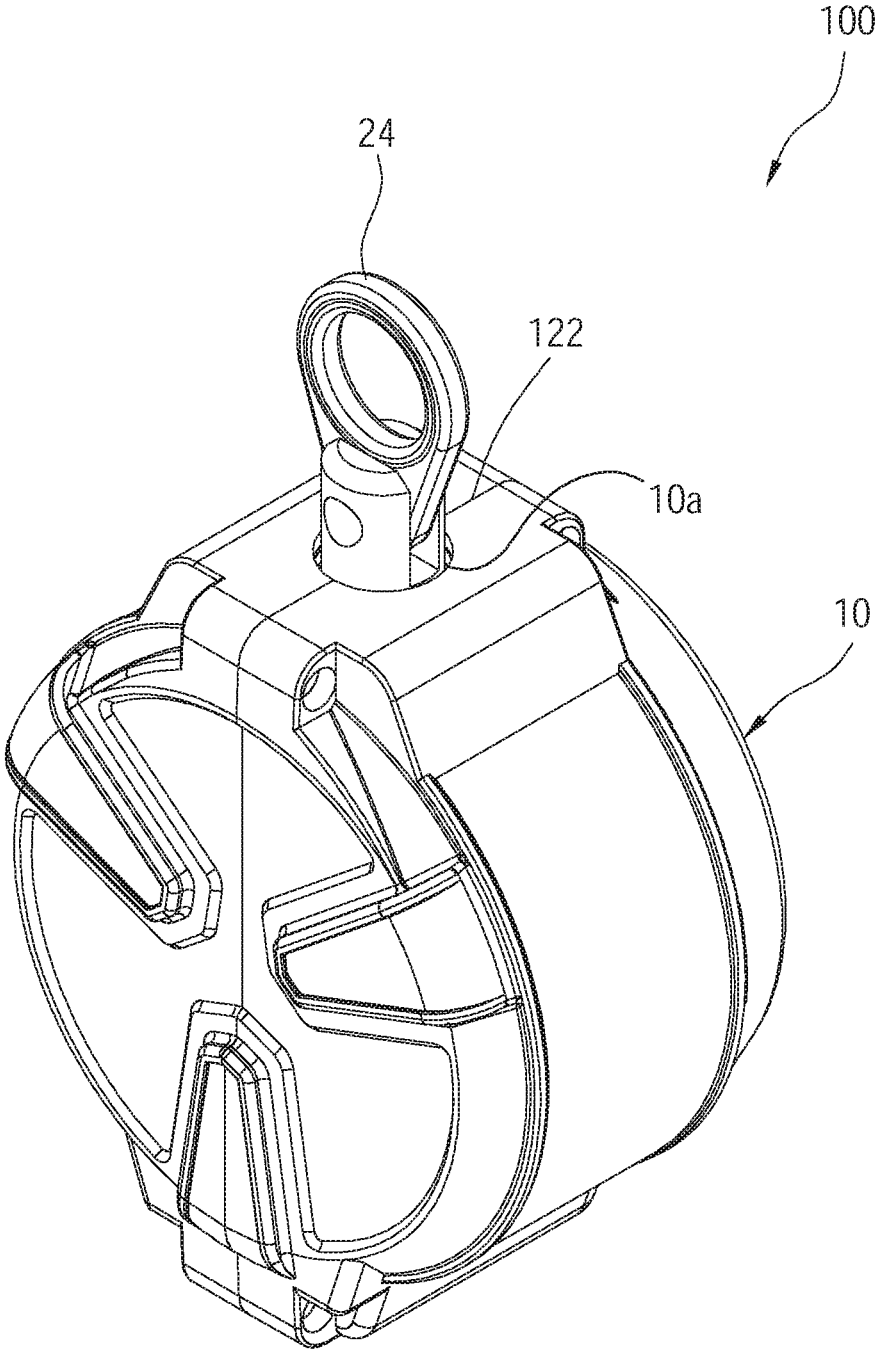
FIG. 1 is a perspective view of a fall protection device of an embodiment according to the present invention.
Figure 2:
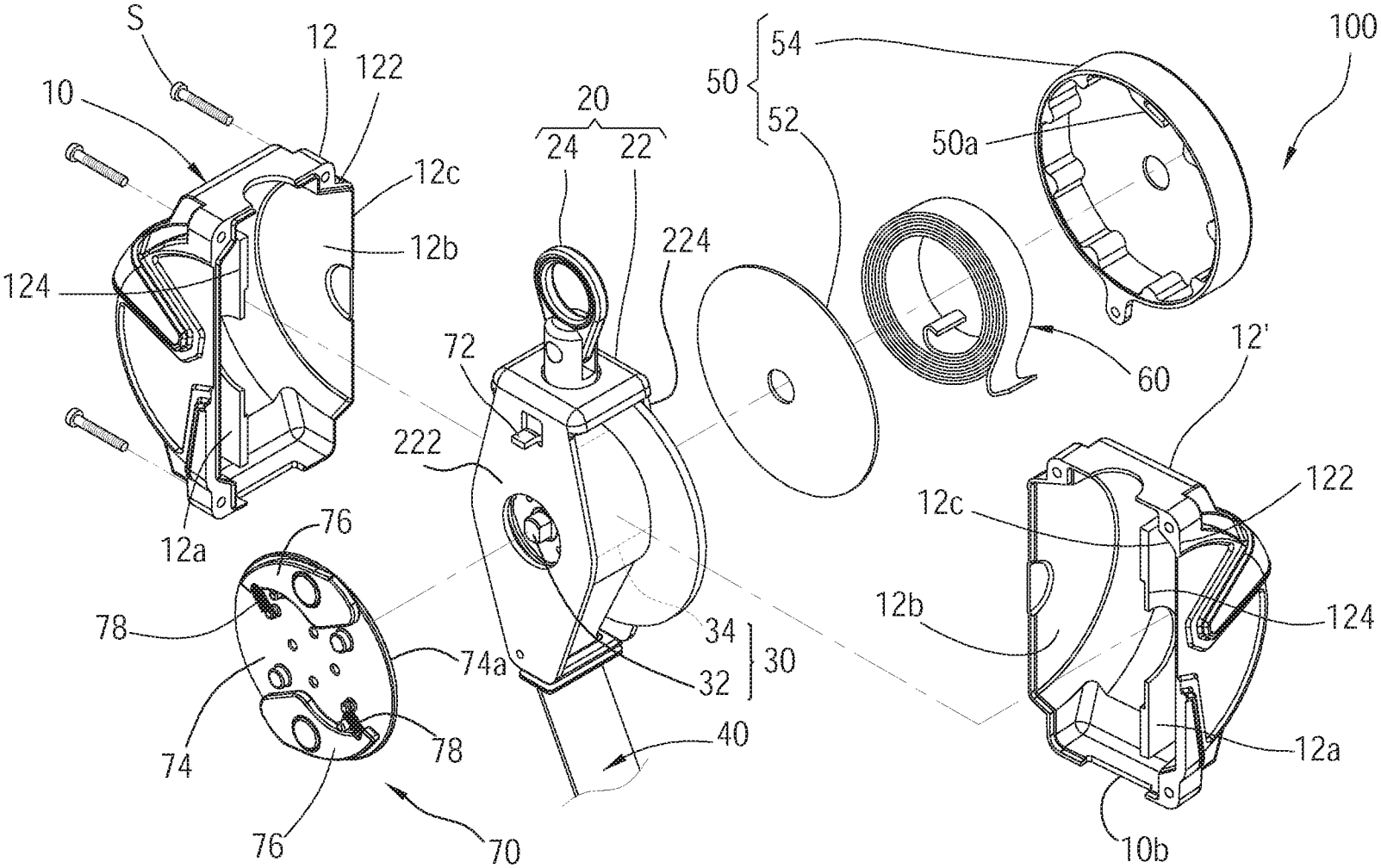
FIG. 2 is an exploded view of the fall protection device of the above embodiment.
Figure 3:
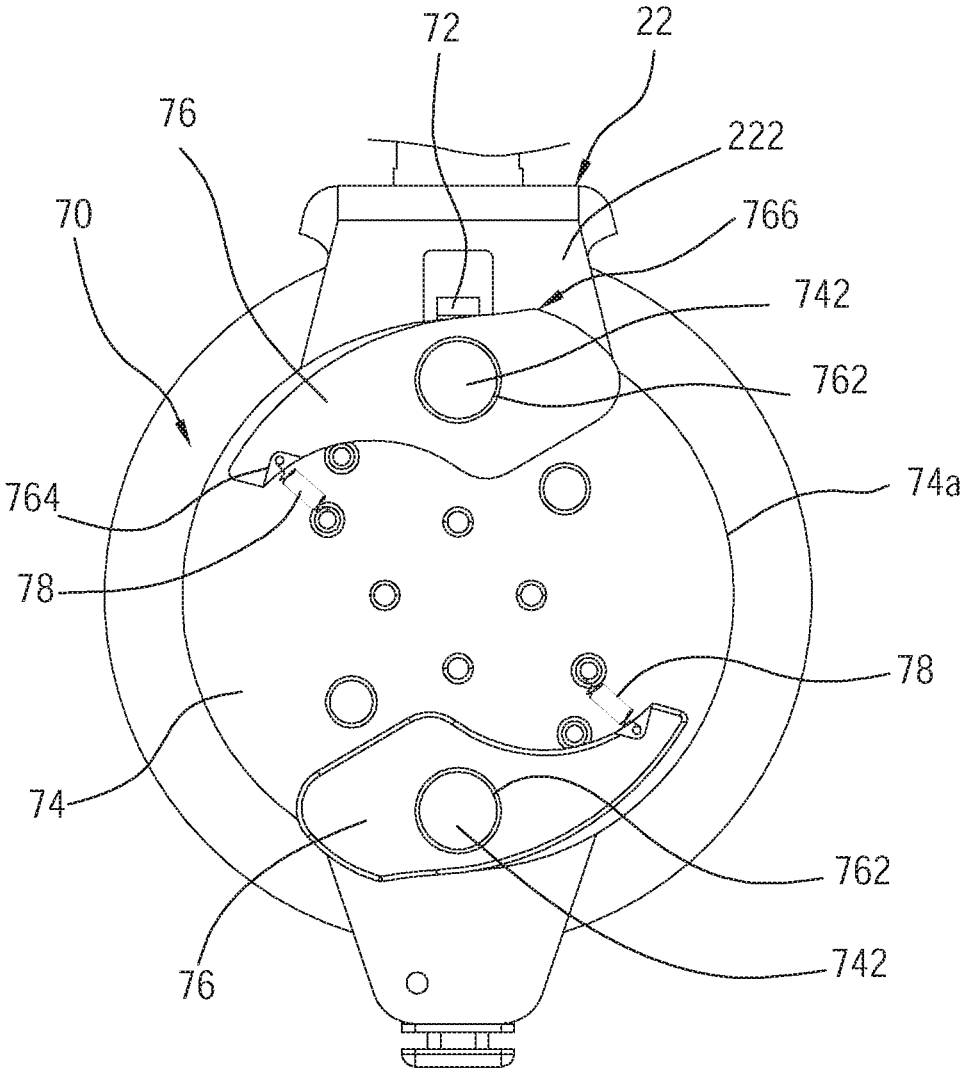
FIG. 3 is a lateral view of the fall protection device of the above embodiment.

Referring to FIG. 1 to FIG. 3, an embodiment of the present invention provides a fall protection device 100. The fall protection device 100 includes a housing 10, a frame 20 disposed in the housing 10, a rotation unit 30, a safety belt 40, a casing 50, a spiral spring 60, and a braking unit 70.

A first half housing 12 and a second half housing 12' are joined to each other and fastened with a plurality of bolts S to constitute the housing 10. Each of the first half housing 12 and the second half housing 12' includes a first chamber 12*a*, a second chamber 12*b*, an opening 12*c*, an exterior abutting surface 122, and an interior abutting surface 124 respectively. The exterior abutting surface 122 is on an edge of the opening 12*c*, and the interior abutting surface 124 is between the first chamber 12*a* and the second chamber 12*b*. When the first half housing 12 joins to the second half housing 12', the exterior abutting surface 122 of the first half housing 12 joins to the exterior abutting surface 122 of the second half housing 12', and the interior abutting surface 124 of the first half housing 12 joins to the interior abutting surface 124 of the second half housing 12'. The housing 10 includes an upper hole 10*a* and a lower hole 10*b*.

The frame 20 includes a frame body 22 and a hanging ring 24 connected to a top of the frame body 22. The frame body 22 includes a first portion 222 and a second portion 224 which are facing each other; the first portion 222 is in the first chambers 12*a* of the first half housing 12 and the second half housing 12'; the second portion 224 is in the second chambers 12*b* of the first half housing 12 and the second half housing 12'. The hanging ring 24 penetrates through the upper hole 10*a* of the housing 10 and extends outwardly.

The rotation unit 30 is rotatably disposed in the first portion 222 and the second portion 224 of the frame body 22 and includes a shaft 32 and a rotary drum 34. Respectively, each of two ends of the shaft 32 penetrates through the first portion 222 and the second portion 224 of the frame body 22. The rotary drum 34 is mounted on the shaft 32 and rotated with the shaft 32 coaxially.

One end of the safety belt 40 is connected to the rotary drum 34 and wound up on the rotary drum 34; another end of the safety belt 40 penetrates through the lower hole 10*b* of the housing 10. The safety belt 40 is adapted to be pulled to drive a rotation of the rotary drum 34 and the shaft 32.

The casing 50 is disposed in the second chambers 12*b* of the first half housing 12 and the second half housing 12' and connected to the second portion 224 of the frame 20. The casing 50 includes a first cover 52 and a second cover 54; a containing space 50*a* is constituted between the first cover 52 and the second cover 54.

The spiral spring 60 is disposed in the containing space 50*a*; an interior end of the spiral spring 60 is connected to the rotation unit 30, and an exterior end of the spiral spring 60 is connected to the casing 50.

The braking unit 70 is disposed in the first chambers 12*a* of the first half housing 12 and the second half housing 12' and includes a stopper 72, a braking plate 74, at least a braking block 76, and at least a restoring spring 78. The stopper 72 is mounted on the frame 20. More particularly in this embodiment, the stopper 72 is mounted on the first portion 222. The stopper 72 is also mounted on the housing 10 and penetrate to the first chambers 12*a* of the first half housing 12 and the second half housing 12'. The braking plate 74 is connected to the shaft 32 of the rotation unit 30 and rotates with the rotation unit 30 coaxially. The braking plate 74 is disk-shaped and includes an periphery side 74*a*. Two pivots 742 are mounted on the braking plate 74, and the stopper 72 is on an outside of the periphery side 74*a*. There are two for each of the braking block 76 and the restoring spring 78. Respectively, each of the braking blocks 76 includes a pivot-joint part, for example, a pivoting hole 762, and the pivot-joint part is pivoted to the pivot 742 of the braking plate 74 to make the braking block 76 swing pivotally between a closing position and an expanding position. Respectively, each of the braking blocks 76 includes a stopping part 764, the stopping part 764 is beside the pivoting hole 762. The stopping part 764 of the braking block 76 can be spun out by a centrifugal force produced by a rotation of the braking plate 74 to abut against the stopper 72 (i.e., the braking block 76 pivotally swings to the expanding position) so as to limit a rotation of the rotation unit 30. Respectively, each of the restoring springs 78 is connected to the braking block 76 and the braking plate 74. Respectively, each of the restoring springs 78 is adapted to draw each of the braking blocks 76 to make the braking blocks 76 be at the closing position in normal situations, such that the stopping part 764 of each of the braking blocks 76 is inside of the periphery side 74*a* in normal situations.

When a user attached with the safety belt 26 falls accidentally, the safety belt 40 is pulled rapidly to drive the rotation unit 30 and the braking plate 74 rotate quickly so as to produce a centrifugal force. The braking blocks 76 are driven by the centrifugal force to overcome the elastic force of the restoring spring 78, and spun out to abut against the stopper 72 to limit the rotation of the rotation unit 30. Such that a pulled-out length of the safety belt 40 is fixed to prevent the user continue to fall.

Accidents would occur if the braking blocks 76 are not able to swing pivotally because a pivoting connection of the braking blocks 76 and the braking plate 74 is jammed by small objects like dust particles. Therefore, the present invention provides a structure for the braking blocks 76.

Figure 4:
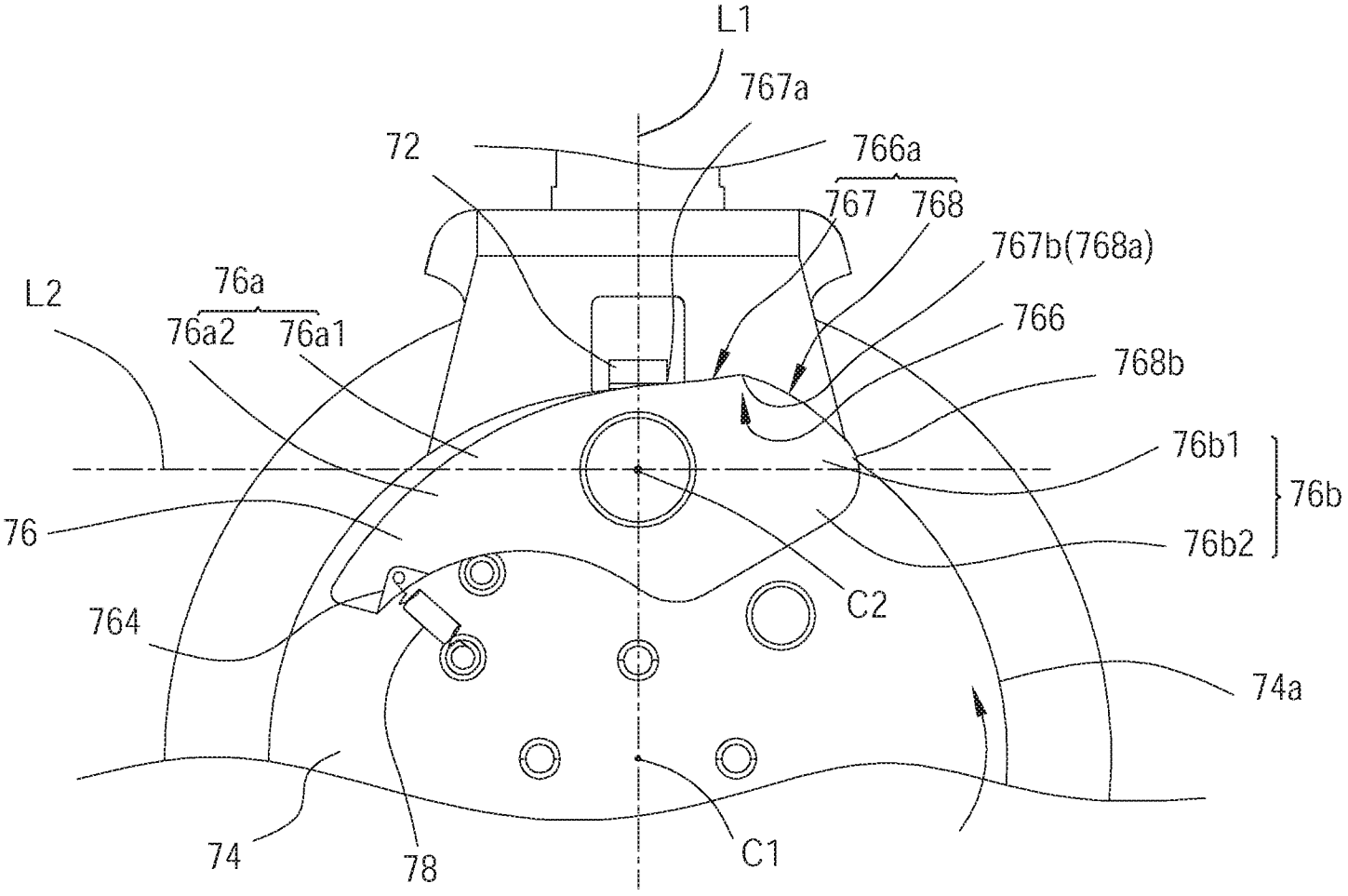
FIG. 4 is a schematic diagram, illustrating partial of the braking unit.

Referring to FIG. 4, the braking block 76 includes an abutted part 766. Respectively, the abutted part 766 and the stopping part 764 are disposed on a two opposite sides of the pivoting hole 762. In this embodiment, when the braking block 76 is at the closing position, a first axis line L1, virtually defined in a plane of a pivoting swing of the braking block 76, passes through a rotation center C1 of the braking plate 74 and the pivot center C2 of the braking block 76. The first axis line L1 divides the braking block 76 into a first portion 76*a* and a second portion 76*b*; the stopping part 764 is in the first portion 76*a*. The restoring spring 78 has one end connected to the first portion 76*a* of the braking block 76 and has another end connected to the braking plate 74 respectively. The abutted part 766 is in the second portion 76*b* of the braking block 76 and moves with the rotation of the braking plate 74 along a circular movement path. The stopper 72 is disposed in the movement path of the abutted part 766 such that the abutted part 766 can be pushed by the stopper 72.

In practice, the abutted part 766 can be pushed by the stopper 72 simply by respectively disposing the stopping part 764 and the abutted part 766 on the two opposite sides of the pivoting hole 762. Besides, the abutted part 766 still can be pushed by the stopper 72, without passing the rotation center C1 of the braking plate 74 with the first axis line L1, once the stopping part 764 and the abutted part 766 are disposed on the two opposite sides of the first axis line L1 respectively.

In this embodiment, when the braking block 76 is at the closing position, a second axis line L2, virtually defined in the plane of a pivoting swing the braking block 76, passes through the pivot center C2 of the braking block 76, and is vertical to the first axis line L1. The second axis line L2 divides the first portion 76*a* of the braking block 76 into a first sub-portion 76*a*1 and a second sub-portion 76*a*2; the second sub-portion 76*a*2 is closer to the rotation center C1 of the braking plate 74 than the first sub-portion 76*a*1. The stopping part 764 is in the second sub-portion 76*a*2, and one end of the restoring spring 78 is connected to the second sub-portion 76*a*2. The second axis line L2 also divides the second portion 76*b* of the braking block 76 into a first sub-portion 76*b*1 and a second sub-portion 76*b*2; the second sub-portion 76*b*2 is closer to the rotation center C1 of the braking plate 74 than the first sub-portion 76*b*1. The abutted part 766 is in the first sub-portion 76*b*1. An outer fringe 766*a* of the abutted part 766 is protruded in an opposite direction of the pivot center C2 of the braking block 76 and is beyond the periphery side 74*a* of the braking plate 74.

The outer fringe 766*a* of the abutted part 766 includes a first section 767 and a second section 768. The first section 767 includes a first starting end 767*b* and a first ending end 767*b*; the second section 768 includes a second starting end 768*a* and a second ending end 768*b*; the first ending end 767*b* is connected to the second starting end 768*a*. A distance between the first section 767 and the rotation center C1 of the braking plate 74 increases gradually in a direction from the first starting end 767*b* to the first ending end 767*b*; a distance between the second section 768 and the rotation center C1 of the braking plate 74 decreases gradually in a direction from the second starting end 768*a* to the second ending end 768*b*. In this embodiment, both of the first section 767 and the second section 768 extend in an arc-shaped manner.

Referring to FIG. 4 to FIG. 7, illustrating a pivoting swing of the braking block 76 before the centrifugal force making the stopping part 764 spin out to abut against the stopper 72 is produced, when the safety belt 40 is pulled, the braking block 76 rotates with the braking plate 74, and when the abutted part 766 of the braking block 76 passes by the stopper 72 with the outer fringe 766*a*, the abutted part 766 is pushed by the stopper 72 so as to make the braking block 76 swing pivotally.

Figure 5:
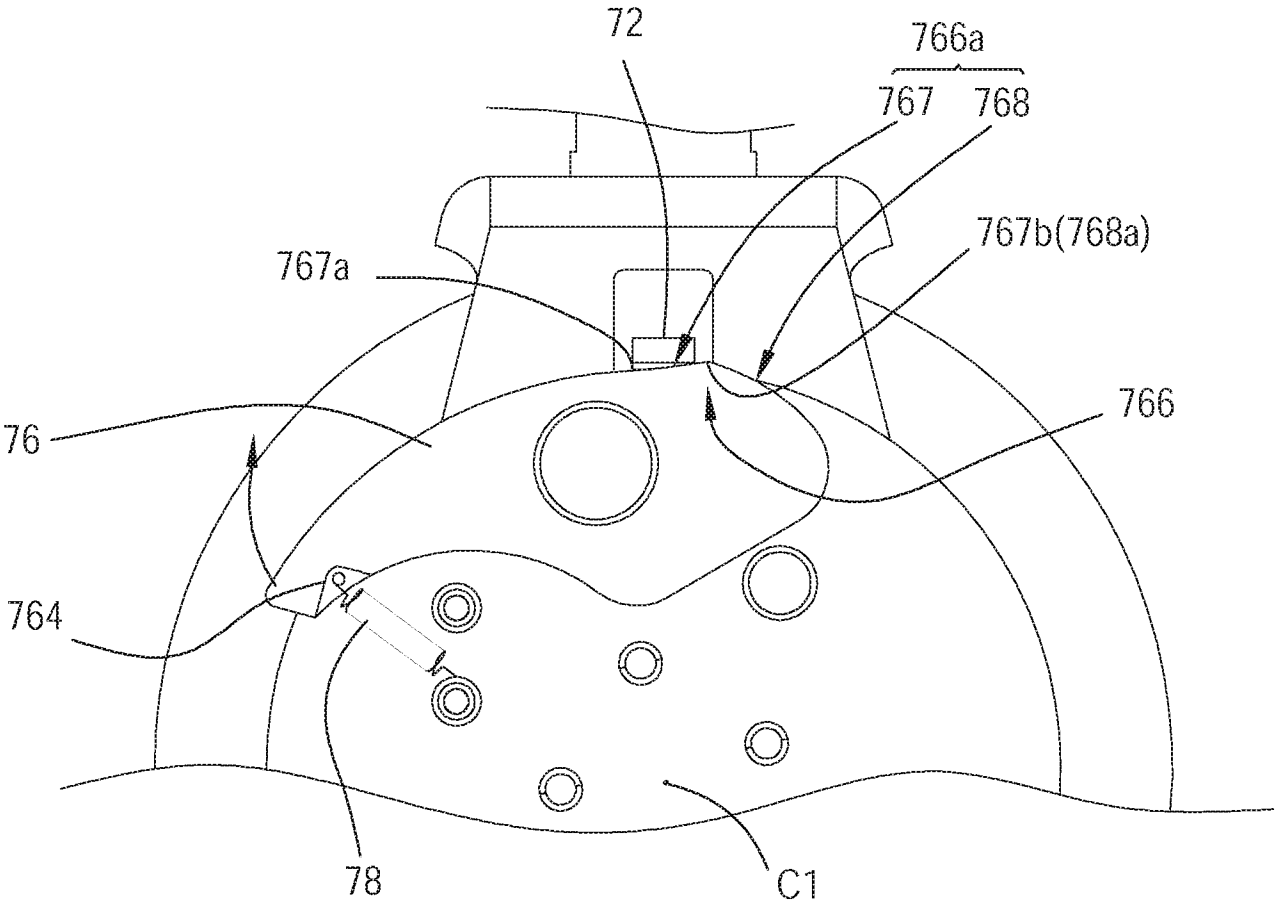
FIG. 5 is a schematic diagram, illustrating a rotation of the braking unit.

Referring to FIG. 4 and FIG. 5, when the abutted part 766 passes by the stopper 72, the first section 767 of the outer fringe 766*a* abuts against the stopper 72 in an order from the direction of the first starting end 767*b* to the first ending end 767*b*, such that a distance between the stopping part 764 of the braking block 76 and the rotation center C1 of the braking plate 74 increase gradually, and the restoring spring 78 is extended. By gradually pushing the first section 767 with the stopper 72, the braking blocks 76 swing outward gradually instead of being spun out rapidly.

Figure 6:
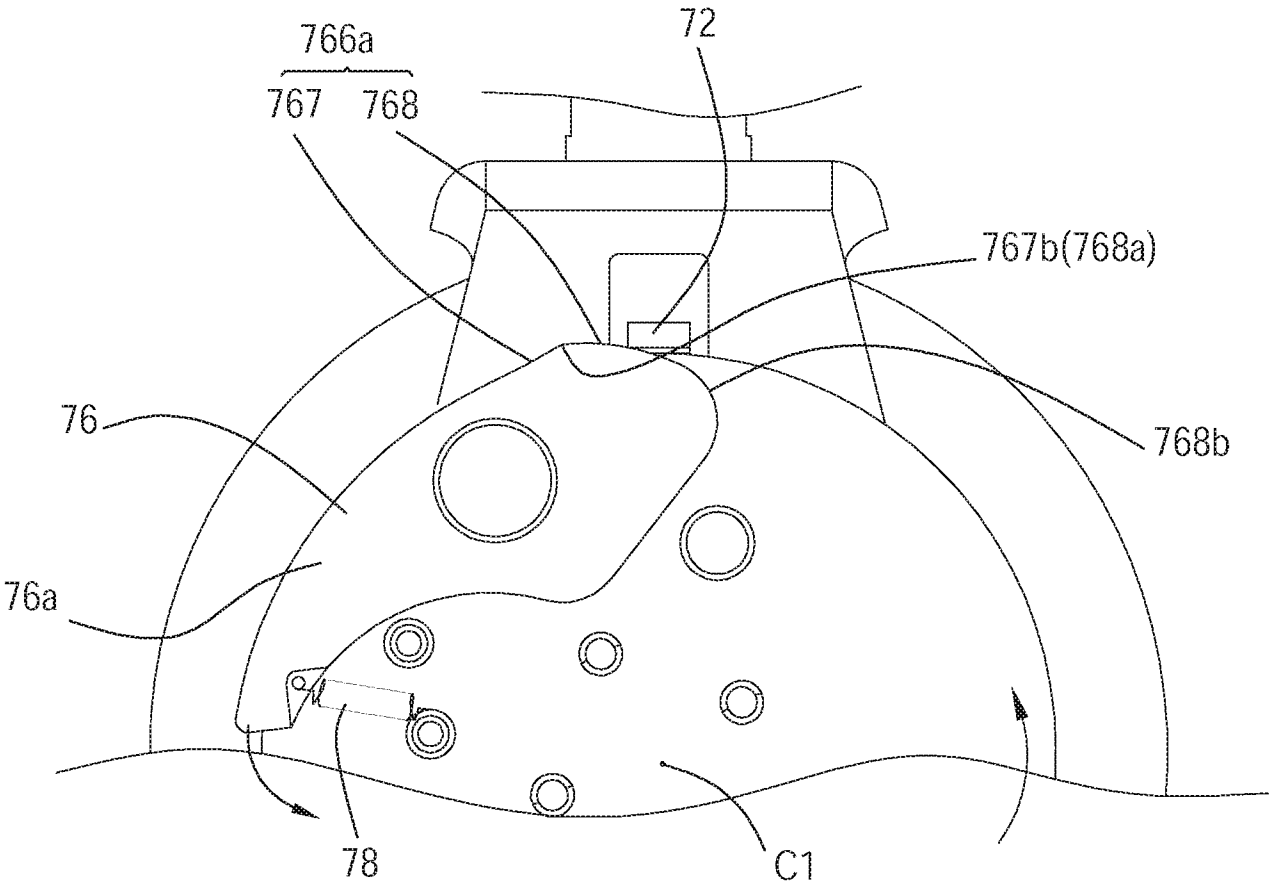
FIG. 6 is a schematic diagram, illustrating the rotation of the braking unit.
Figure 7:
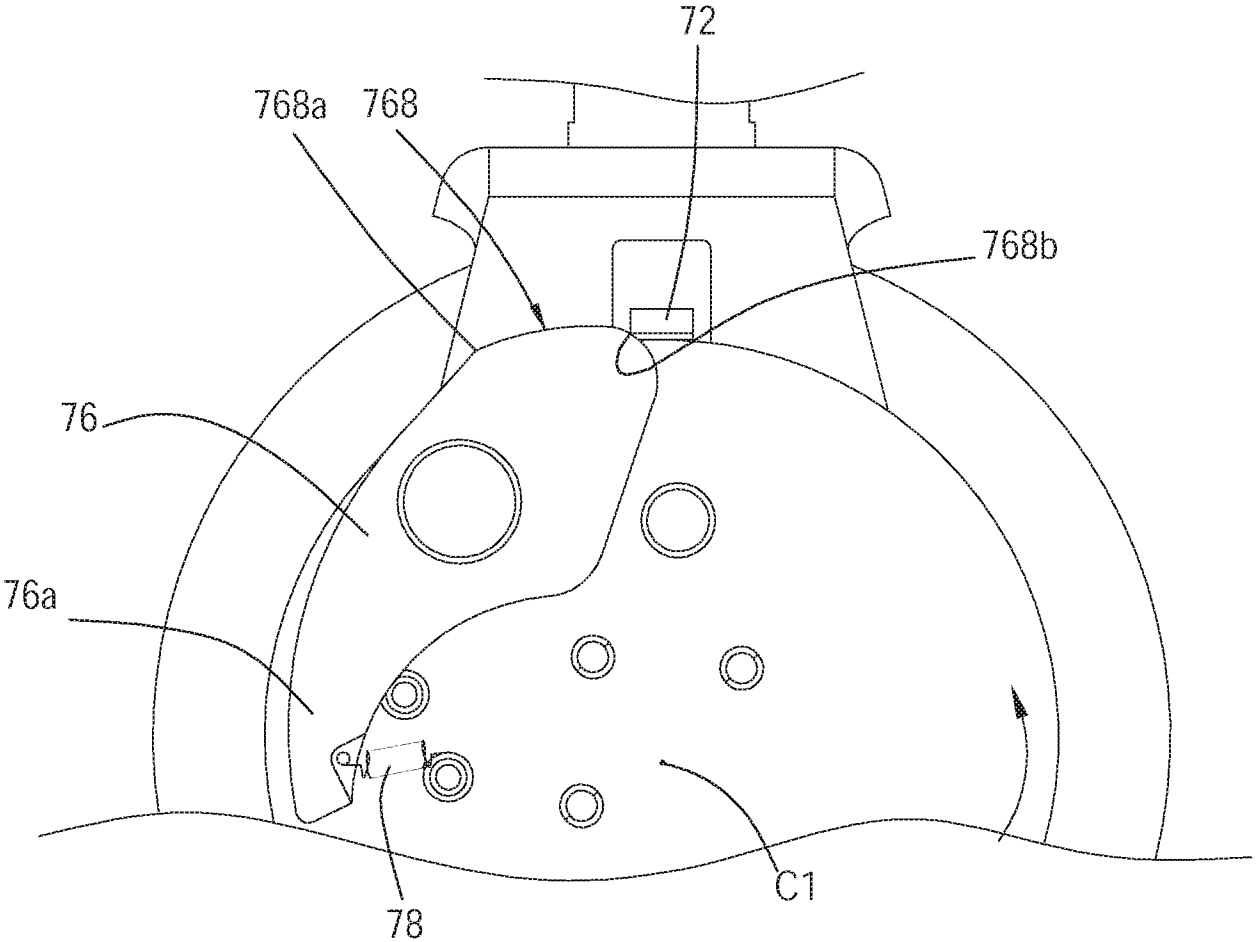
FIG. 7 is a schematic diagram, illustrating the rotation of the braking unit.

Referring to FIG. 6 and FIG. 7, when the second section 768 of the outer fringe 766*a* passes by the stopper 72, the second section 768 abuts against the stopper 72 in an order from the direction of the second starting end 768*a* to the second ending end 768*b*. Such that an elastic force the restoring spring 78 recovers, and the restoring spring 78 pulls the first portion 76*a* of the braking block 76 towards the rotation center C1 of the braking plate 74. By gradually pushing the second section 768 with the stopper 72 and pulling with the restoring spring 78, the braking block 76 reverts back to its original position steadily.

Thus, the user can pull the safety belt 100 in advance to check the vibrations produced by the swing of the braking block 76 and confirm the fall protection device 100 operates normally. It is worth to mention that when the braking block 76 is locked and unable to pivotally swing, the stopping part 766 of the braking block 76 will abut against the stopper 72 to limit the rotation of the rotation unit 30 so as to prevent the user continue to fall. Those are protections brought from the fall protection device 100.

It must be pointed out that the embodiments described above are only some embodiments of the present invention. All equivalent structures which employ the concepts disclosed in this specification and the appended claims should fall within the scope of the present invention.

What is claimed is:

1. A fall protection device, comprising a frame, a rotation unit, a safety belt, and a brake unit; wherein, the rotation unit is rotatably disposed in the frame; and the safety belt is wound up on the rotation unit, and adapted to be pulled to drive a rotation of the rotation unit; the brake unit comprises a braking plate, a braking block, and a stopper; the braking plate is connected to the rotation unit and is rotated with the rotation unit coaxially; the braking block comprises a pivot-joint part pivotally connected to the braking plate, and comprises a stopping part; the stopping part of the braking block can be spun out by a centrifugal force produced by a rotation of the braking plate to abut against the stopper to limit the rotation of the rotation unit; the fall protection device is characterized in that:

the braking block, including an abutted part, wherein the abutted part and the stopping part are respectively disposed on a two opposite sides of the pivot-joint part; the abutted part moves with a rotation of the braking plate along a movement path; and the stopper is disposed in the movement path of the abutted part;

wherein the braking block pivotally swings between a closing position and an expanding position; in normal situations when the fall protection device operates normally, the braking block is at the closing position, when the abutted part passes by the stopper, the abutted part is abutted against by the stopper to make the braking block swing pivotally so the abutting positioning of the abutted part against the stopper is gradual when the safety belt is pulled in the normal situations;

wherein the stopping part abuts against the stopper to stop a rotation of the rotation unit only when the braking block is at the expanding position, wherein the braking plate includes a periphery side; an outer fringe of the abutted part is protruded in an opposite direction of the pivot center of the braking block, and is beyond the periphery side; and when the abutted part passes by the stopper, the abutted part passes by with the outer fringe and abuts against the stopper.

2. The fall protection device of claim 1, wherein when the braking block is at the closing position, a first axis line, virtually defined on a pivoting swing plane of the braking block, passes through the pivot center of the braking block and divides the braking block into a first portion and a second portion; the stopping part is in the first portion and the abutted part is in the second portion.

3. The fall protection device of claim 2, wherein the first axis line passes through the pivot center of the braking block and a rotation center of the braking plate.

4. The fall protection device of claim 2, wherein when the braking block is at the closing position, a second axis line, virtually defined in a plane of the pivoting swing of the braking block, passes through the pivot center of the braking block and is vertical to the first axis line; the second axis line divides the second portion of the braking block into a first sub-portion and a second sub-portion; the second sub-portion is closer to the rotation center of the braking plate than the first sub-portion; and the abutted part is in the first sub-portion.

5. The fall protection device of claim 4, wherein the outer fringe of the abutted part includes a first section and a second section; the first section includes a first starting end and a first ending end; the first ending end is connected to the second section; a distance between the first section and the rotation center of the braking plate increases gradually in a direction from the first starting end to the first ending end; when the abutted part passes by the stopper, the first section abuts against the stopper in an order from the direction of the first starting end to the first ending end to make a distance between the stopping part of the braking block and the rotation center of the braking plate increase gradually.

6. The fall protection device of claim 5, further comprising a restoring spring, having one end connected to the first portion of the braking block and another end connected to the braking plate respectively; wherein the second section of the outer fringe of the abutted part includes a second starting end and a second ending end; the second starting end is connected to the first ending end; a distance between the second section and the rotation center of the braking plate decreases gradually in a direction from the second starting end to the second ending end; when the first section of the outer fringe of the abutted part passes by the stopper, the restoring spring is extended; when the second section of the outer fringe of the abutted part passes by the stopper, the second section abuts against the stopper in an order from the direction of the second starting end to the second ending end, an elastic force the restoring spring recovers, and the restoring spring pulls the first portion of the braking block towards the pivot center of the braking plate.

7. The fall protection device of claim 6, wherein the second section extends in an arc-shaped manner.

* * * * *